US010704752B1

(12) United States Patent
Zhu

(10) Patent No.: US 10,704,752 B1
(45) Date of Patent: Jul. 7, 2020

(54) LAMP

(71) Applicant: Ganzhou SHANGJIE Technologies Co., Ltd., Ganzhou (CN)

(72) Inventor: Jianjun Zhu, Huizhou (CN)

(73) Assignee: GANZHOU SHANGJIE TECHNOLOGIES CO., LTD., Ganzhou (CN)

( * ) Notice: Subject to any disclaimer, the term of this patent is extended or adjusted under 35 U.S.C. 154(b) by 0 days.

(21) Appl. No.: 16/354,075

(22) Filed: Mar. 14, 2019

(30) Foreign Application Priority Data

Dec. 12, 2018 (CN) ..... 2018 1 1518580

(51) Int. Cl.

| | |
|---|---|
| ***F21S 10/04*** | (2006.01) |
| ***F21V 23/00*** | (2015.01) |
| ***F21V 3/06*** | (2018.01) |
| ***F21S 9/03*** | (2006.01) |
| ***F21V 3/02*** | (2006.01) |
| *F21Y 105/18* | (2016.01) |
| *F21Y 115/10* | (2016.01) |
| *F21Y 115/15* | (2016.01) |

(52) U.S. Cl.
CPC ..... *F21S 10/04* (2013.01); *F21S 9/037* (2013.01); *F21V 3/02* (2013.01); *F21V 3/0625* (2018.02); *F21V 23/003* (2013.01); *F21V 23/005* (2013.01); *F21Y 2105/18* (2016.08); *F21Y 2115/10* (2016.08); *F21Y 2115/15* (2016.08)

(58) Field of Classification Search
CPC ..... F21S 10/04; F21S 10/043; F21S 9/037; F21V 3/0625; F21V 23/003; F21V 23/005; F21V 3/02; F21Y 2105/18; F21Y 2115/15
See application file for complete search history.

(56) References Cited

U.S. PATENT DOCUMENTS 5,924,784 A * 7/1999 Chliwnyj ..... H05B 37/029 362/234
10,344,930 B1 * 7/2019 Mitchell, Jr. ..... F21K 9/23
(Continued)

FOREIGN PATENT DOCUMENTS

CN 202733564 U 2/2013
CN 204087753 U 1/2015

OTHER PUBLICATIONS

European Patent Office, European Search Report, App. No. 19164333.7-1015.

*Primary Examiner* — Alan B Cariaso
(74) *Attorney, Agent, or Firm* — Hemisphere Law, PLLC; Zhigang Ma

(57) ABSTRACT

A lamp includes a lamp base, a lamp cover fixedly connected to the lamp base, and a light source module electrically connected to the lamp base and housed in a space enclosed by the cover and the lamp base. The light source module includes a second plate electrically connected to the lamp base, a first plate connected to the second plate, a dot matrix light source disposed on a first surface of the first plate, and an optical cover covered on the first surface of the first plate. As the dot matrix light source is capable of displaying different preset patterns, the lamp of the invention can provide bright illumination while displaying a dynamic preset pattern according to the practical needs so that images of real objects to be simulated can be vividly presented, creating the certain specific atmosphere.

13 Claims, 6 Drawing Sheets

(56) References Cited

U.S. PATENT DOCUMENTS

| | | | | |
|---|---|---|---|---|
| 10,352,515 | B1 * | 7/2019 | Yin | F21S 6/001 |
| 10,436,401 | B2 * | 10/2019 | Lee | G09G 3/2085 |
| 2005/0196716 | A1 * | 9/2005 | Haab | F21S 6/001 431/126 |
| 2016/0057829 | A1 | 2/2016 | Li | |
| 2016/0305615 | A1 | 10/2016 | Bukkems et al. | |
| 2016/0356428 | A1 | 12/2016 | Edmond et al. | |
| 2018/0033358 | A1 * | 2/2018 | Patton | G09G 3/3225 |

* cited by examiner

LAMP

BACKGROUND OF THE INVENTION

1. Field of the Invention

The present invention relates to the technical field of illumination, and in particular to a lamp.

2. Description of Related Art

A lamp, the source of illumination that emits heat and glows through electricity, was invented by Henrys Goebbels (Edison actually found the suitable material, i.e. a practical incandescent lamp, whereas the lamp appears earlier in 1854). The traditional lamps only have lighting function. Although they can provide illumination for the life of people, some specific display effects may not be displayed, either to create certain specific atmosphere; if the candle used at the birthday celebration can be replaced, it will not only create a celebration atmosphere, but also solve many problems such as the large pollution of traditional flame candles and potential safety hazards; if the torch handle can be replaced in the team building, it will not only contribute to the atmosphere creation, but also avoid conflagration caused by traditional torch; therefore, it is desirable to develop a lamp for illumination and preset pattern display to create a special display effect.

BRIEF DESCRIPTION OF THE SEVERAL VIEWS OF THE DRAWING(S)

The foregoing and other exemplary purposes, aspects and advantages of the present invention will be better understood in principle from the following detailed description of one or more exemplary embodiments of the invention with reference to the drawings, in which.

DETAILED DESCRIPTION OF THE INVENTION

Figure 1:
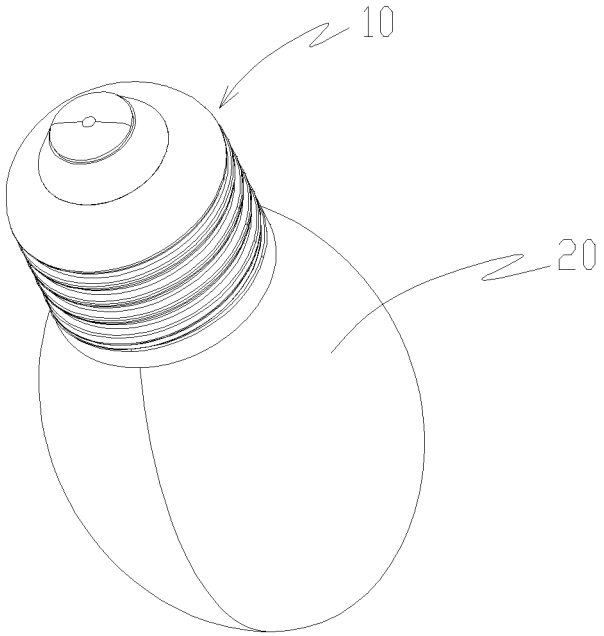
FIG. 1 is a perspective view of a lamp in accordance with a first embodiment of the present invention.
Figure 2:
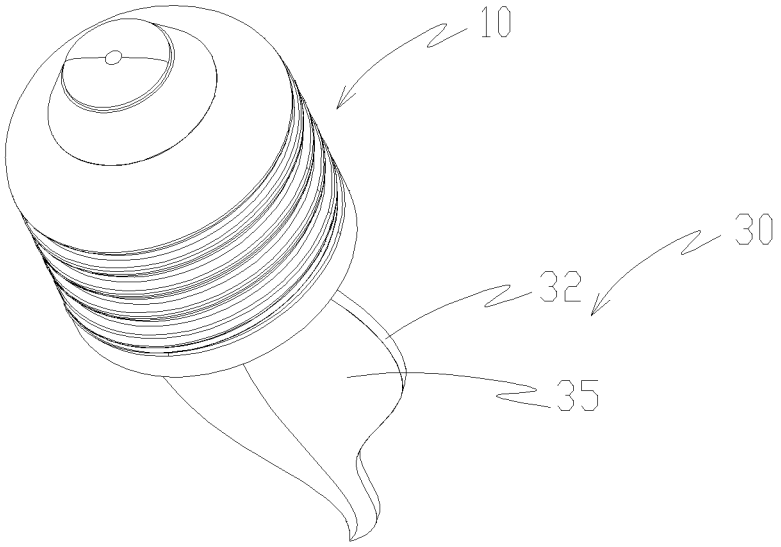
FIG. 2 is a perspective view of a lamp having a lamp cover removed in accordance with the first embodiment of the present invention.
Figure 3A:
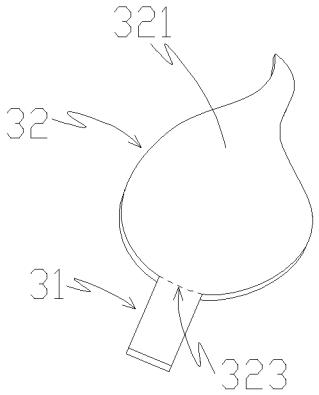
FIG. 3A and FIG. 3B are perspective views of a second plate and a first plate in accordance with the first embodiment of the present invention.
Figure 3B:
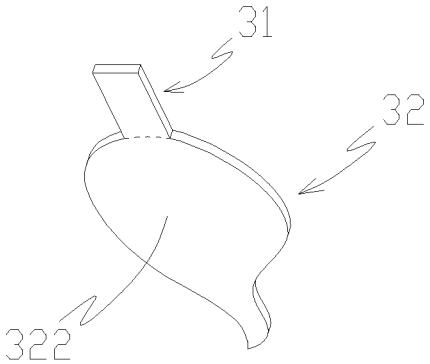
Figure 3C:
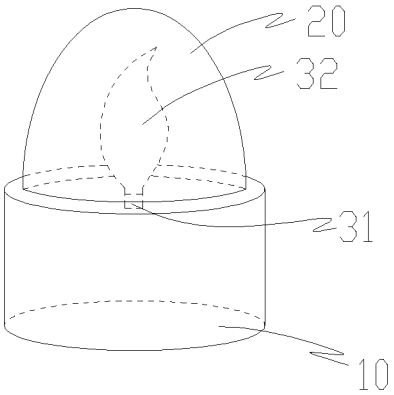
FIG. 3C is a perspective view of a lamp showing a connection between a second plate and a lamp base.

The invention will now be described in detail through several embodiments with reference to the accompanying drawings.

Referring to FIGS. 1-3 and FIGS. 5-6, a lamp in accordance with a first embodiment of the invention includes: a lamp base 10, a lamp cover 20 connected to the lamp cap 1 to define a receiving space for containing a light source module 30. In the embodiment, the lamp cover 11 is in a shuttle type with a three-dimensional structure and is transparent. In practice, the lamp cover 20 may be manufactured in two parts, forming a two-stage type. The lamp base 10 has a screw cap which is capable of being screwed with a matched socket so that can be electrically connected to an external power source through a matched socket (In FIG. 3C, the screw cap is replaced by a cylinder).

The light source module 30 includes a second plate 31 connected to the lamp base 10, a first plate 32 connected to the second plate 31, a control circuit 33 fixed on the second plate 31 and electrically connected to lamp base 10, and plural of LED sources or OLED light sources 34 to form a first dot matrix light source 341 and a second dot matrix light source 342 for illuminating and displaying preset patterns. The first LED dot matrix light source 341 is electrically connected to the control circuit 33 and fixed on a first surface 321 of the first plate 32. The second LED dot matrix light source 342 is electrically connected to the control circuit 33 and fixed on a second surface 322 of the first plate 32.

The first plate 32 is substantially a flat panel and is formed in a flame shape viewed in a direction perpendicular to the surfaces (the first and the second surfaces 321, 322) of the first plate 32. The flame shape means that when the first plate 32 is viewed in a direction perpendicular to the surfaces of the first plate 32, its shaped made its looked like a candle flame. In detail, a width of the first plate 32 gradually increases from a flame-shaped root portion 323 of the first plate 32, and reaches the maximum in the middle part of the first plate 32, and then begins to gradually shrink, so that the end (top portion) of the first plate has a slender tip. The second plate 31 extends integrally from a flame-shaped root portion 323 of the first plate 32 and is a rectangular plate. In the embodiment, the first and the first plate 31, 32 are both printed circuit board, may be chosen from: a glass fiber circuit board, an aluminum-based circuit board, and a copper-based circuit board. In other embodiments, the first or the first plate may be a metal plastic bracket.

A first optical cover 35 is covered on the first surface 321 of the first plate 32 to received the first LED dot matrix light source 341 in a space defined by the first optical cover 35 and the first surface 321. A second first optical cover 36 is covered on the second surface 322 of the first plate 32 to received the second LED dot matrix light source 342 in a space defined by the second optical cover 36 and the second surface 322.

In the embodiment, both of the first optical cover 35 and the second optical cover 36 are made from epoxy resin containing scattering powder and are transparent or semi-transparent. The first optical cover 35 and the second optical cover 36 may have a graded thickness with an thin edge and thickened intermediate, and both are dyed red mixed with orange for simulating flame color of a candle. In particularly, a periphery of the first and the second optical covers 35, 36 are fixedly connected to a periphery of the two surfaces 321, 322 of the first plate 32 respectively, and a middle of each of the first and the second optical covers 35, 36 is convex with respect to the surface of the first plate 32, and the middle of each of the first and the second optical covers 35, 36 is in smooth transition to the periphery of the first and the second optical covers 35, 36.

The first first optical cover 35 and the second optical cover 36 are both spaced from the lamp cover 20 by a certain distance. In particular, the optical covers disposed on the front and back sides of the first plate are combined into a flame-shaped cover with a three-dimensional structure.

In the first embodiment, the second plate 31 in a rectangular shape with a flat structure and the first plate 32 having a flame shape with a flat structure are integrally formed as a one-piece printed circuit board. The lamp base 10 has a screw cap. The preset patterns that the dot matrix light source may display include, but not limited to a candle flame, a flower, a fireworks, et al. A dynamic flame effect may be realized by the control of the control circuit.

Figure 4A:
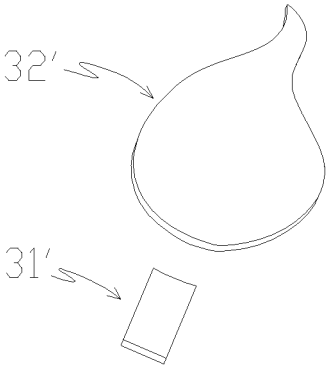
FIG. 4A is a perspective views of a second plate and a first plate in accordance with a variation example of the first embodiment of the present invention.
Figure 4B:
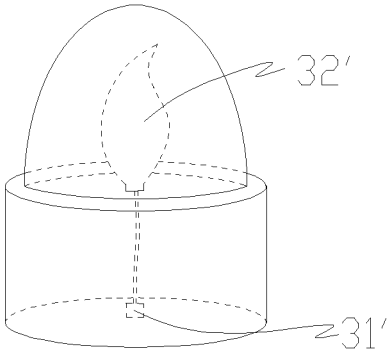
FIG. 4B is a perspective view of a lamp showing relationships between a first plate, a second plate and a lamp base.
Figure 5:
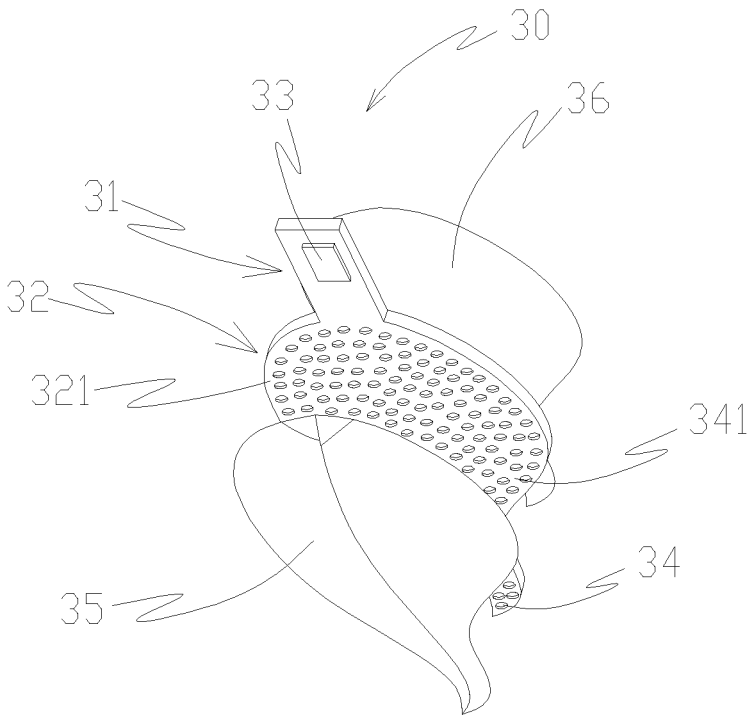
FIG. 5 is an exploded view of a light source module including the second plate, the first plate, a first optical cover, and a second optical cover in accordance with the first embodiment of the present invention.
Figure 6:
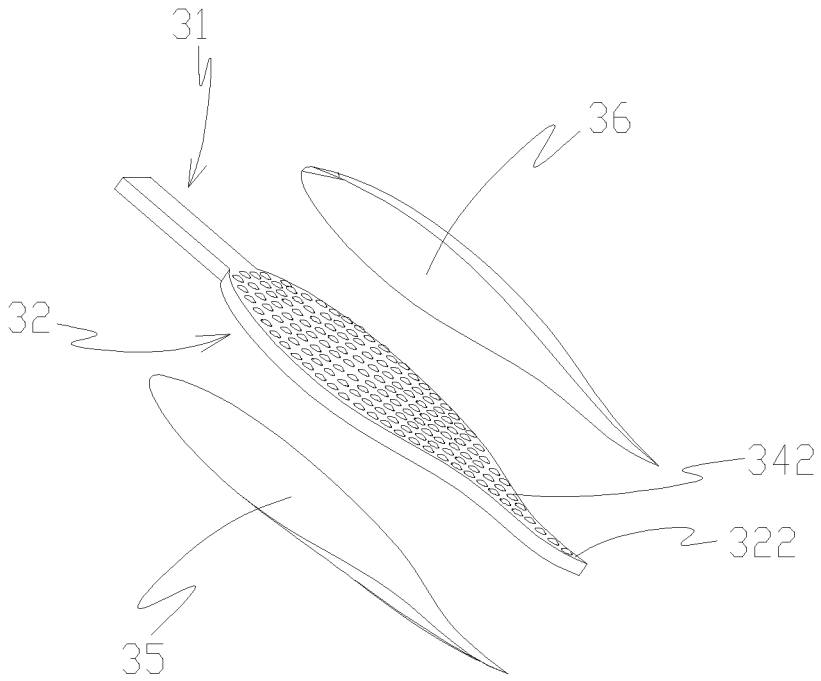
FIG. 6 is another exploded view of the light source module from another perspective in accordance with the first embodiment of the present invention.

In a variation embodiment as shown in FIG. 4A, the second plate 31' and the first plate 32' may be independent parts with each other. Under this situation, the flame-shaped root portion of the first plate 32' may be connected to the lamp base directly and the second plate 31' may be received in the lamp base and electrically connected to the lamp base and the first plate 32' respectively, as shown in FIG. 4B. In other embodiments, the second plate may be omitted. In other embodiment, a part of the second plate may be attached on the first plate, or a terminal of the second plate may be connected to a flame-shaped root portion of the first plate.

Figure 7:
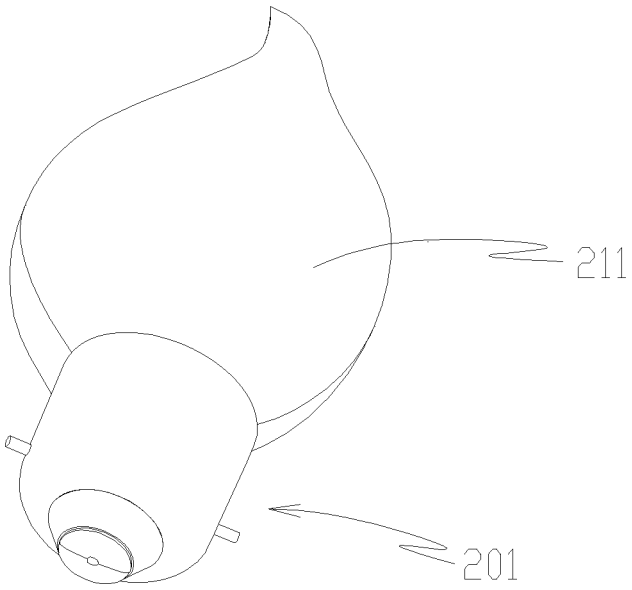
FIG. 7 is a perspective view of a lamp in accordance with a second embodiment of the present invention.

Referring to FIG. 7, a lamp in accordance with a second embodiment of the invention is illustrated. The differences between the lamp in the second embodiment and the lamp in the first embodiment are the shape of the lamp cover 211 and the type of the lamp base. In the second embodiment, the lamp base 201 has a bayonet used for electrically connected to a matched socket so as to be electrically connected to the external power supply. The lamp cover 211 is in a flame shape with a three-dimensional structure, which more intuitively shows the image of a real candle flame and can exhibit a more realistic candle flame effect.

Figure 8:
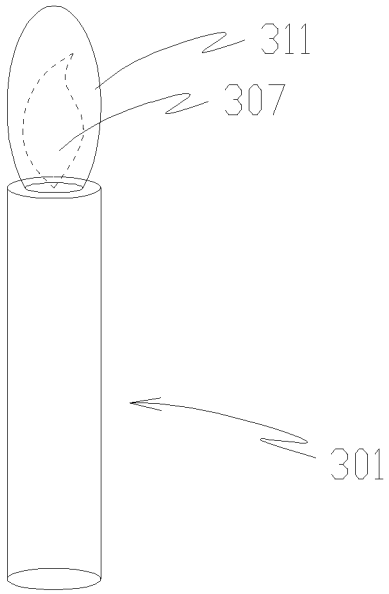
FIG. 8 is a perspective view of a lamp in accordance with a third embodiment of the present invention.

Referring to FIG. 8, a lamp in accordance with a third embodiment of the invention is illustrated. The differences between the lamp in the third embodiment and the lamp in the first embodiment is the shape of the lamp base. In the third embodiment, the lamp base 301 has a cylindrical shape to imitate a candle body. The control circuit on the second plate may be electrically connected to a power adapter fixed in the lamp base 301, and the power adapter is capable of electrically connected to an external power supply. The shuttle-shaped lamp cover 311 protects the candle flame displayed on the first plate 3207 therein.

Understandably, in a variation example of the third embodiment, the lamp base 301 may defined a battery box therein. The first and the second LED dot matrix light sources are electrically connected to the control circuit, and the control circuit on the second plate is electrically connected to the battery box in the lamp base 301. That is, the lamp may not be powered by external power supplies, but by batteries fixed in the lamp base.

Figure 9:
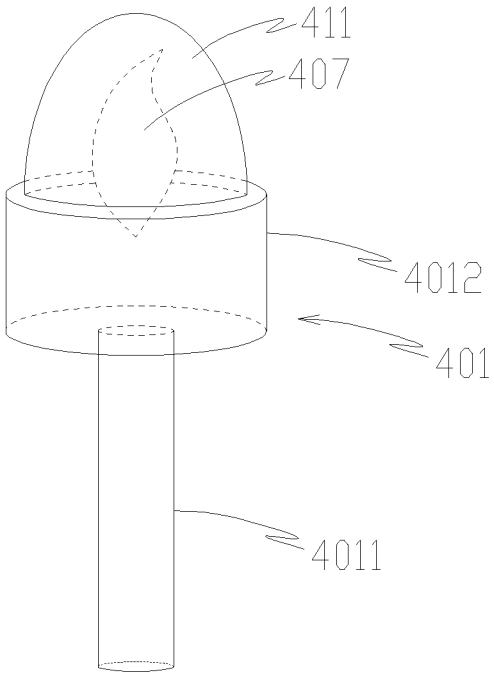
FIG. 9 is a perspective view of a lamp in accordance with a fourth embodiment of the present invention.

Referring to FIG. 9, a lamp in accordance with a fourth embodiment of the invention is illustrated. The differences between the lamp in the fourth embodiment and the lamp in the first embodiment is the shape of the lamp base. In the fourth embodiment, the lamp has a torch shape having a long handle 4011 and a column 4012 with a lager diameter than the long handle 4011. The cover 411 protects the flame displayed on the first plate 407 therein. Similarly to the third embodiment and its variation example, the lamp in the fourth embodiment may be powered by an external power supply or internal batteries.

Figure 10:
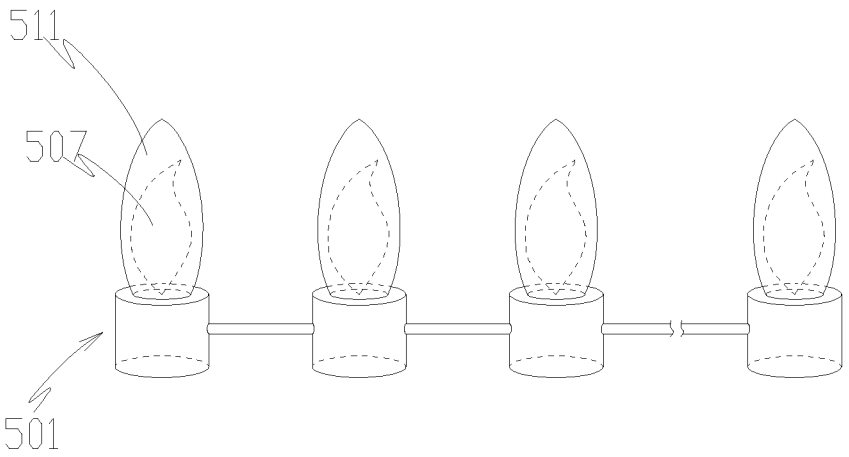
FIG. 10 is a perspective view of a lamp in accordance with a fifth embodiment of the present invention.

Referring to FIG. 10, a lamp in accordance with a fifth embodiment of the invention is illustrated. The differences between the lamp in the fifth embodiment and the lamp in the first embodiment is the shape of the lamp base and the number of the lamp. In the fifth embodiment, the lamp base 501 has a column shape, and there are plural of lamps electrically connected in series into a light string. The lamp bases 501 are connected to each other, and the cover 511 protects the patterns displayed on the first plate 507 therein.

Figure 11:
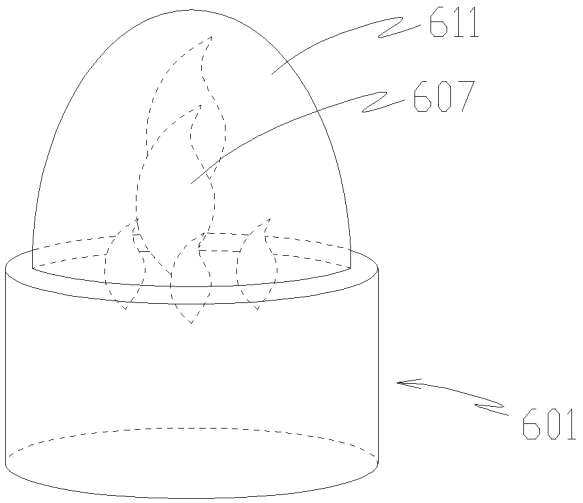
FIG. 11 is a perspective view of a lamp in accordance with a sixth embodiment of the present invention.

Referring to FIG. 11, a lamp in accordance with a sixth embodiment of the invention is illustrated. The differences between the lamp in the sixth embodiment and the lamp in the first embodiment is the shape of the lamp base 601 and the number of the light source modules 607 fixed on the lamp base 601. The lamp base 601 has a column shape, the enclosed space between the lamp base 601 and the cover 611 are provided with plural light source modules 607 similar to the light source module in FIGS. 5-6. Each light source modules 607 is used for displaying a preset pattern.

Figure 12:
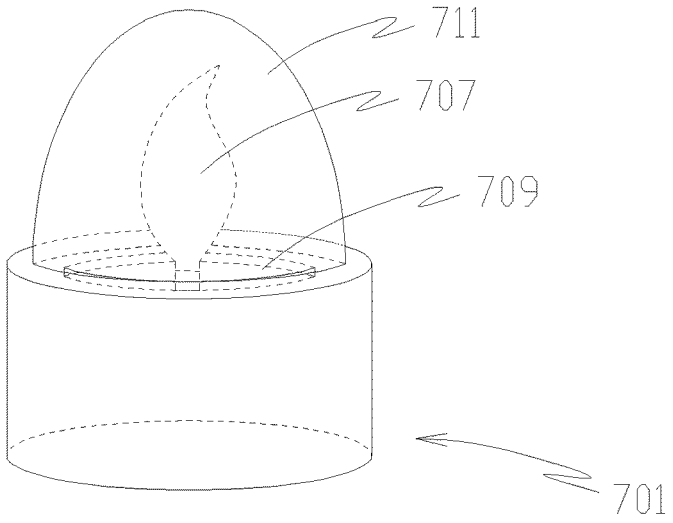
FIG. 12 is a perspective view of a lamp in accordance with a seventh embodiment of the present invention.
Figure 13:
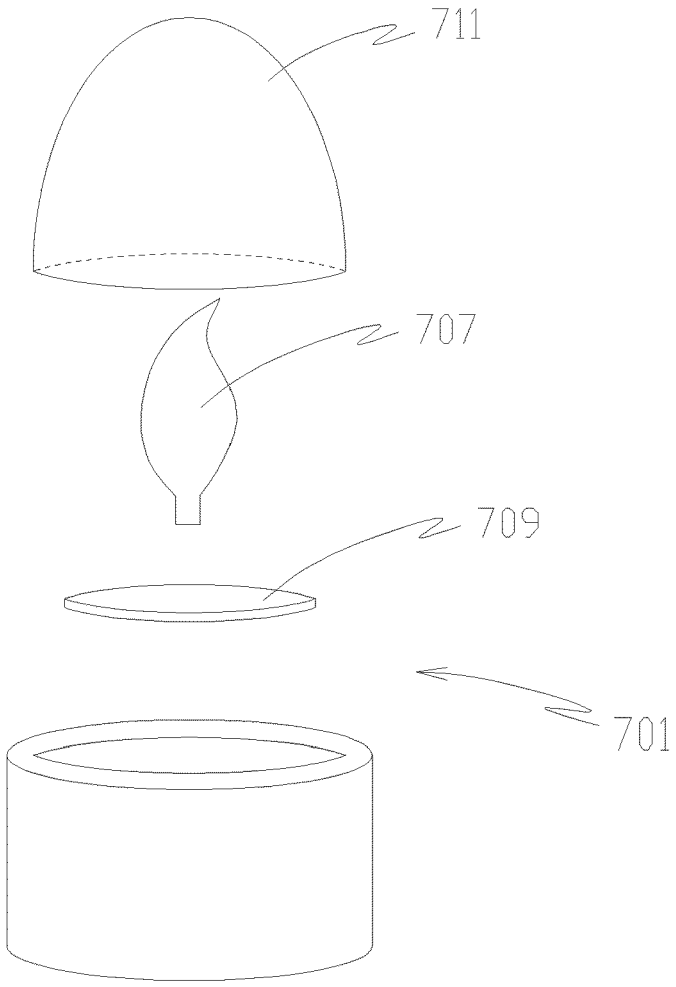
FIG. 13 is an exploded view of the lamp in FIG. 12.

Referring to FIG. 12 and FIG. 13, a lamp in accordance with a seventh embodiment of the invention is illustrated. The differences between the lamp in the seventh embodiment and the lamp in the first embodiment is the shape of the lamp base 701 and a power supply to the light source module 707. The lamp base 701 has a column shape and defines a receiving space for receiving a solar photovoltaic panel 709 electrically connected to the light source module 707. The lamp cover 711 is transparent and the solar photovoltaic panel 709 can absorb natural light through the lamp cover 711. The lamp base 701 may also has a battery box, so that batteries act as an auxiliary power supply.

From the first embodiment to the seventh embodiment, the dot matrix light sources are driven by the control circuit to display one or more preset patterns those can be dynamic if actually needed, so that images of a real object to be simulated can be vividly presented, creating the certain specific atmosphere. If the candle used at the birthday celebration can be replaced, it will not only create a celebration atmosphere, but also solve many problems such as the large pollution of traditional flame candles and potential safety hazards; if the torch handle can be replaced in the team building, it will not only contribute to the atmosphere creation, but also avoid conflagration caused by traditional torch. A variety of realistic atmospheres can be created without pollution and safety hazards. For the purpose of further enhancing the realistic effect of the simulated object, the two sides of the first plate are provided with LED dot matrix whose surface is covered by an optical cover with a double-sided dot matrix structure, so that the display effect of the object to be simulated can be viewed by 360° without dead angles, and the addition of the optical cover makes the preset pattern more transparent, real and natural.

In above embodiments, the first plate is substantially flat plate. It is understandably, the first plate may be a curved plate to simulate a flickering mode of a candle flame.

In other embodiment, there may be only one dot matrix light source fixed on one of the two surfaces of the first plate.

In other embodiments, other types of lamp beads may be used instead of the LEDs to form a dot matrix light source, as long as a preset pattern can be displayed.

In other embodiments, the shape of the first plate may be circular, polygonal, or the like, and the overall pattern formed by the dot matrix light source may be a flame shape, or may be rectangular, polygonal, or the like.

In other embodiments, the lamp base can be other types of cap that may be applied to a lamp.

In other embodiments, a dot matrix light source is disposed on one of the two surfaces of the first plate, and no light source is disposed on the other surface.

In other embodiments, the lamp cover may be omitted.

In other embodiments, the color of the optical cover may be different depending on the pattern to be displayed by the dot matrix light source.

In other embodiments, the periphery of the optical cover is fixedly connected to the periphery of the first plate, and the middle of the optical cover is convex with respect to the surface of the first plate; the middle of the optical cover is in smooth transition to the periphery of the optical cover, and the periphery of the optical cover is approximately parallel to the surface of the first plate.

In the above embodiment, the optical cover is separately formed (that is, independently formed with respect to other components). In other embodiments, a transparent or scattering-containing resin may be printed on the first plate and the dot matrix light source to form the optical cover, that is there is no space between the optical cover and the first plate or the dot matrix light source.

In other embodiments, the second plate and the first plate are separate, and the first plate is connected to the flame-shaped root of the second plate, and the two plates may be partially stacked or vertically fixedly connected.

In other embodiments, the control circuit may also be divided into two parts, respectively disposed on the front and back sides of the second plate.

In other embodiments, the power supply mode is AC, DC, battery or solar energy.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A lamp, comprising:

a lamp base;

a lamp cover fixedly connected to the lamp base; and a light source module electrically connected to the lamp base and housed in a space defined by the lamp cover and the lamp base;

wherein the light source module comprises:

a first plate electrically connected to the lamp base;

a plurality of light sources forming a first dot matrix light source and a second dot matrix light source respectively configured on both surfaces of the first plate; and two optical covers;

wherein outer edge of each optical cover is fixedly connected to an outer edge of one of the two surfaces of the first plate, and a middle part of each optical cover is convex with respect to the surface of the first plate; the middle of the optical cover is in smooth transition to the outer edge of the optical cover, and outer part near the outer edge of the optical cover is substantially parallel to the surface of the first plate;

wherein the first and the second dot matrix light sources are both used as an illumination light source and as a display screen.

2. The lamp of claim 1, wherein the first plate is formed in a flame shape viewed in a direction perpendicular to the surface of the first plate.

3. The lamp of claim 2, wherein the optical covers are made from epoxy resin containing scattering powder.

4. The lamp of claim 3, wherein color of the optical covers is configured for simulating flame color of a candle.

5. The lamp of claim 4, further comprising:

a second plate connected to the first plate; and a control circuit configured on one or both two surfaces of the second plate;

wherein the control circuit is configured for controlling the first dot matrix light source and the second dot matrix light source to display one or two preset patterns.

6. The lamp of claim 5, wherein the second plate and the first plate are one of the following printed circuit boards: a glass fiber circuit board, an aluminum-based circuit board, a copper-based circuit board and a metal plastic bracket; the plurality of light sources are LED light sources or OLED light sources, and the lamp base is a screw cap or a bayonet cap or a cap having a solar photovoltaic panel electrically connected to the first and the second dot matrix light sources.

7. The lamp of claim 1, further comprising:

a second plate connected to the first plate; and a control circuit configured on the second plate for controlling the first dot matrix light source to display a preset pattern.

8. The lamp of claim 7, wherein the second plate extends integrally from the first plate.

9. The lamp of claim 7, wherein the second plate and the first plate are independent of each other, the second plate is connected to the flame-shaped root portion of the first plate.

10. The lamp of claim 7, wherein the second plate and the first plate are independent of each other, the second plate is received in the lamp base and the first plate is fixed to the lamp base and is electrically connected to the control circuit on the second plate.

11. The lamp of claim 1, wherein there are a plurality of light source modules electrically connected to the lamp base and housed in the space defined by the lamp cover and the lamp base.

12. The lamp of claim 1, wherein the lamp base has a column shape and defines a receiving space for receiving a solar photovoltaic panel electrically connected to the light source module; the lamp cover is transparent so that the solar photovoltaic panel can absorb natural light through the lamp cover.

13. The lamp of claim 1, wherein the two optical covers are fixedly connected to the surfaces of the first plate and are formed by printing a transparent or scattering-containing resin on the two surfaces of the first plate.

* * * * *